US006089127A

United States Patent [19]

Dominguez

[11] Patent Number: 6,089,127

[45] Date of Patent: Jul. 18, 2000

[54] MODIFIED WRENCH

[76] Inventor: Jesus V. Dominguez, 2 Eileen St., Watsonville, Calif. 95076

[21] Appl. No.: 09/213,121

[22] Filed: Dec. 17, 1998

[51] Int. Cl.[7] ..... B25B 13/02

[52] U.S. Cl. ..... 81/119; 81/125; 81/124.3

[58] Field of Search ..... 81/119, 121.1, 81/125, 125.1, 13, 180.1, 185.1, 185, 177.2, 177.85, 124.3, 124.7, 186

[56] References Cited

U.S. PATENT DOCUMENTS

| | | | |
|---|---|---|---|
| 150,180 | 4/1874 | Morris | 81/124.3 X |
| 1,367,297 | 2/1921 | Bullard | 81/119 |
| 1,615,497 | 1/1927 | Woods | 81/125 X |
| 1,754,717 | 4/1930 | Hughens | 81/125 X |
| 1,936,352 | 11/1933 | Dixon | 81/125.1 |
| 2,800,822 | 7/1957 | Allred | 81/125 |
| 3,875,828 | 4/1975 | Evans | 81/124.3 X |
| 5,230,263 | 7/1993 | Kwaka | 81/124.3 X |
| 5,307,713 | 5/1994 | White | 81/119 X |
| 5,943,924 | 8/1999 | Jarvis | 81/185 X |

FOREIGN PATENT DOCUMENTS

| | | | |
|---|---|---|---|
| 403281176 | 12/1991 | Japan | 81/119 |

*Primary Examiner*—D. S. Meislin

[57] ABSTRACT

A wrench is provided including a handle and at least one end extent coupled to an end of the handle. The end extent includes a cut out defining an inner periphery formed of an inboard portion with a smooth substantially arcuate configuration with a predetermined diameter. The inner periphery of the end extent has an engagement outboard portion defined by a pair of linear parallel edges spaced a predetermined distance less than the predetermined diameter.

5 Claims, 4 Drawing Sheets

MODIFIED WRENCH

BACKGROUND OF THE INVENTION

1. Field of the Invention

The present invention relates to wrenches and more particularly pertains to a new modified wrench for rotating a nut or bolt with a unitary wrench in a reciprocating without removing the wrench from the nut or bolt.

2. Description of the Prior Art

The use of wrenches is known in the prior art. More specifically, wrenches heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,417,129; U.S. Pat. No. 5,501,124; U.S. Pat. No. 2,578,410; U.S. Pat. No. 4,441,387; U.S. Pat. No. Des. 344,223; and U.S. Pat. No. Des. 299,206.

In these respects, the modified wrench according to the present invention substantially departs from the conventional concepts and designs of the prior art, and in so doing provides an apparatus primarily developed for the purpose of rotating a nut or bolt with a unitary wrench in a reciprocating without removing the wrench from the nut or bolt.

SUMMARY OF THE INVENTION

In view of the foregoing disadvantages inherent in the known types of wrenches now present in the prior art, the present invention provides a new modified wrench construction wherein the same can be utilized for rotating a nut or bolt with a unitary wrench in a reciprocating without removing the wrench from the nut or bolt.

The general purpose of the present invention, which will be described subsequently in greater detail, is to provide a new modified wrench apparatus and method which has many of the advantages of the wrenches mentioned heretofore and many novel features that result in a new modified wrench which is not anticipated, rendered obvious, suggested, or even implied by any of the prior art wrenches, either alone or in any combination thereof.

To attain this, the present invention generally comprises a plurality of wrenches each including an intermediate extent having a linear generally planar rectangular configuration. As shown in FIG. 1, a first end extent of the wrench includes a substantially planar C-shaped bar coupled to a first end of the intermediate extent in coplanar relationship therewith. An inner periphery of the C-shaped bar is formed of an inboard portion with a smooth semi-circular configuration with a predetermined diameter. A middle portion is defined by a pair of linear parallel edges spaced a predetermined distance less than the predetermined diameter. Ideally, each of the parallel edges of the middle portion has a length about equal to the predetermined diameter. The C-shaped bar is further defined by an outboard portion formed of a pair of inwardly extending converging edges. With continuing reference to FIG. 1, each wrench further includes a second end extent including a substantially planar O-shaped bar. The O-shaped bar is coupled to a second end of the intermediate extent in coplanar relationship therewith. A plurality of teeth are formed in an inner periphery of the O-shaped bar which has a diameter equal to the predetermined distance. Ideally, the plurality of wrenches are provided in a kit with the C-shaped bars of the wrenches each having a unique distance between the edges of the middle portion thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new modified wrench apparatus and method which has many of the advantages of the wrenches mentioned heretofore and many novel features that result in a new modified wrench which is not anticipated, rendered obvious, suggested, or even implied by any of the prior art wrenches, either alone or in any combination thereof.

It is another object of the present invention to provide a new modified wrench which may be easily and efficiently manufactured and marketed.

It is a further object of the present invention to provide a new modified wrench which is of a durable and reliable construction.

An even further object of the present invention is to provide a new modified wrench which is susceptible of a low cost of manufacture with regard to both materials and labor, and which accordingly is then susceptible of low prices of sale to the consuming public, thereby making such modified wrench economically available to the buying public.

Still yet another object of the present invention is to provide a new modified wrench which provides in the apparatuses and methods of the prior art some of the advantages thereof, while simultaneously overcoming some of the disadvantages normally associated therewith.

Still another object of the present invention is to provide a new modified wrench for rotating a nut or bolt with a unitary wrench in a reciprocating without removing the wrench from the nut or bolt.

Even still another object of the present invention is to provide a new modified wrench that includes a handle and at least one end extent coupled to an end of the handle. The end extent includes a cut out defining an inner periphery formed of an inboard portion with a smooth substantially arcuate configuration with a predetermined diameter. The inner periphery of the end extent has an engagement outboard portion defined by a pair of linear parallel edges spaced a predetermined distance less than the predetermined diameter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
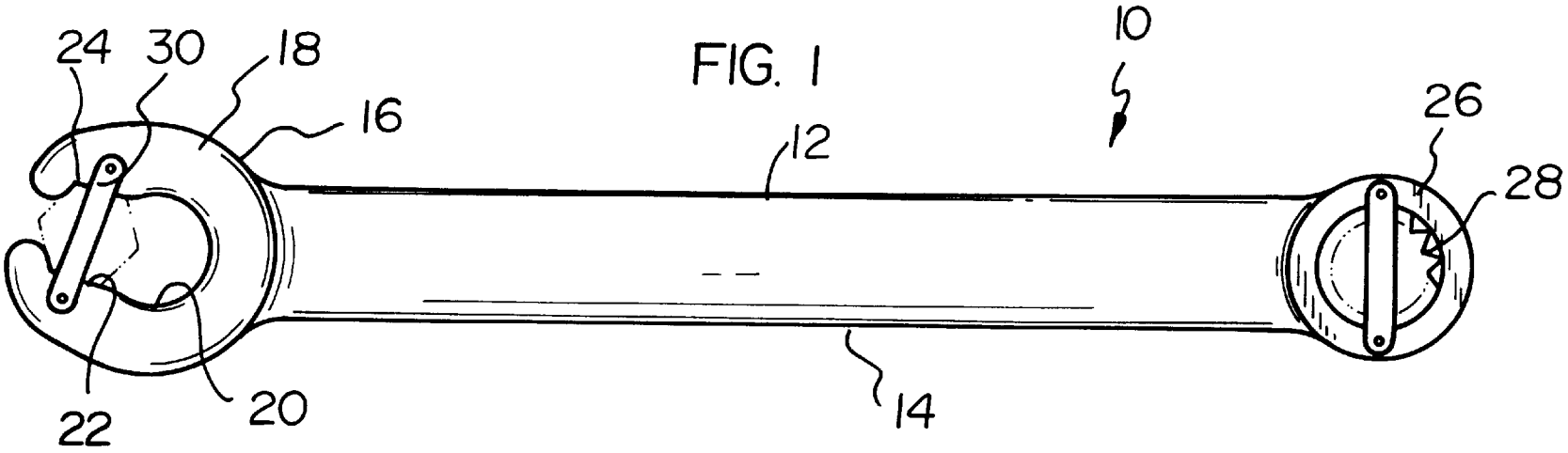
FIG. 1 is a top view of a new modified wrench according to the present invention.
Figure 2:
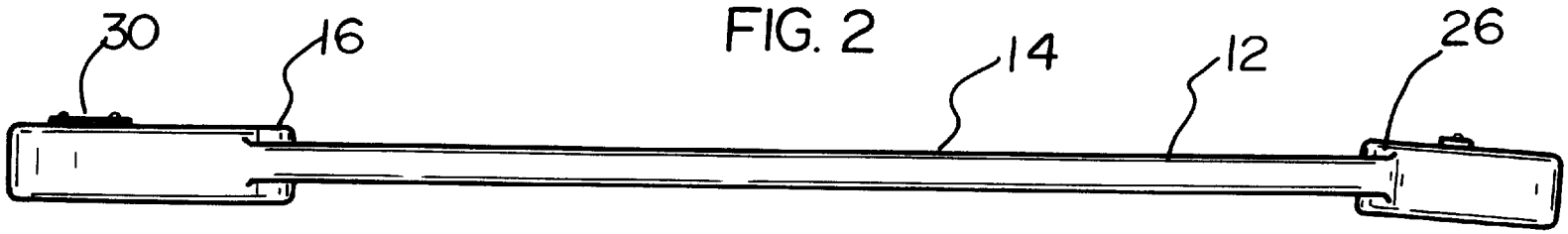
FIG. 2 is a side view of the present invention.
Figure 5:
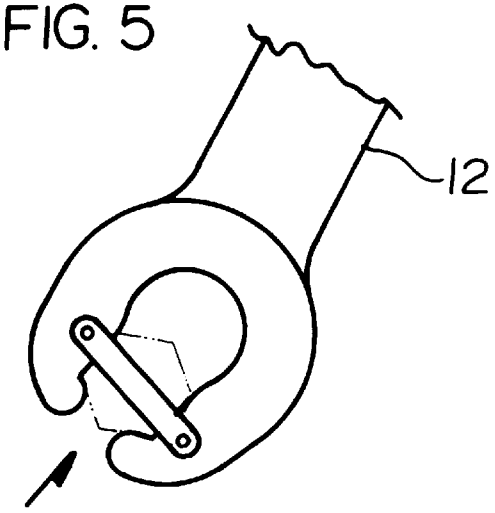
FIGS. 3–6 show the operation and use of the present invention.
Figure 6:
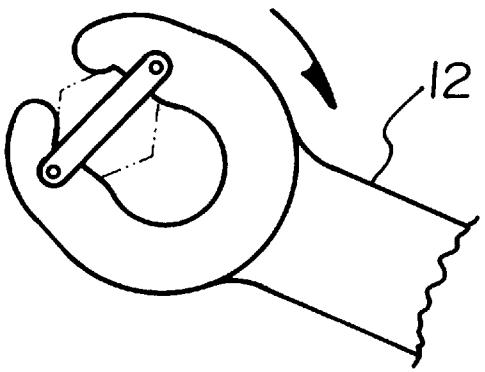

With reference now to the drawings, and in particular to FIGS. 1 through 12 thereof, a new modified wrench embodying the principles and concepts of the present invention and generally designated by the reference numeral 10 will be described.

The present invention, designated as numeral 10, includes a plurality of wrenches 12 each including an intermediate extent 14 having a linear generally planar rectangular configuration. As shown in FIG. 1, a first end extent 16 of the wrench includes a substantially planar C-shaped bar 18 coupled to a first end of the intermediate extent in coplanar relationship therewith. An inner periphery of the C-shaped bar is formed of an inboard portion 20 with a smooth semi-circular configuration with a predetermined diameter. A middle portion 22 of the inner periphery of the C-shaped bar is defined by a pair of linear parallel edges spaced a predetermined distance less than the predetermined diameter. Ideally, each of the parallel edges of the middle portion has a length about equal to the predetermined diameter. The C-shaped bar is further defined by an outboard portion 24 formed of a pair of inwardly extending converging edges.

Figure 3:
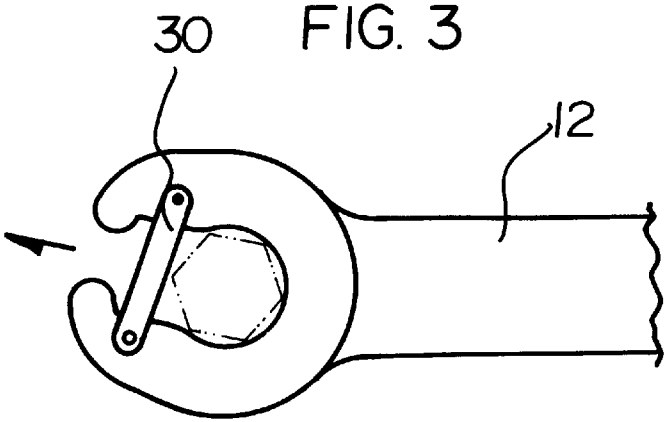
Figure 4:
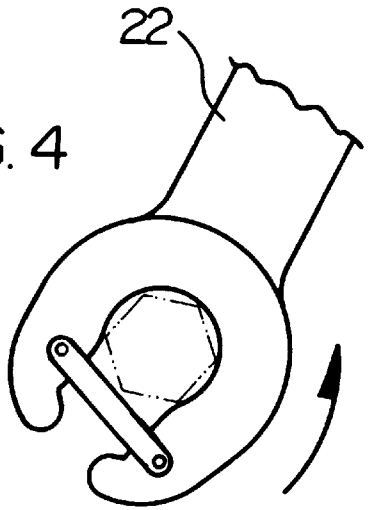

In use, the C-shaped bar may be positioned over a head of a bolt or a nut such that the inboard portion of the inner periphery abuts the same, as shown in FIG. 3. Next, the wrench is moved along axis including its handle, thereby inserting the bolt or nut between the edges of the middle portion of the inner periphery and in abutment with the outboard portion. Note FIG. 5. Thereafter, the wrench is rotated after which the foregoing process is reversed and repeated until the bolt or nut is loosened or tightened as desired. See FIGS. 5 & 6.

With continuing reference to FIG. 1, each wrench further includes a second end extent 26 including a substantially planar O-shaped bar. The O-shaped bar is coupled to a second end of the intermediate extent in coplanar relationship therewith. A plurality of teeth 28 are formed in an inner periphery of the O-shaped bar which has a diameter equal to the predetermined distance. Ideally, the plurality of wrenches are provided in a kit with the C-shaped bars of the wrenches each having a unique distance between the edges of the middle portion thereof.

In a first embodiment, each wrench has a bar 30 fixedly mounted thereon over both end extents for abutting a top face of a head of a bolt during use. The bar of the first end extent has a longitudinal axis which remains in perpendicular relationship with the edges of the outboard portion of the end extent. Further, such bar extends across to centers of the edges of the middle portion of the end extent. Note FIG. 1.

Figure 10:
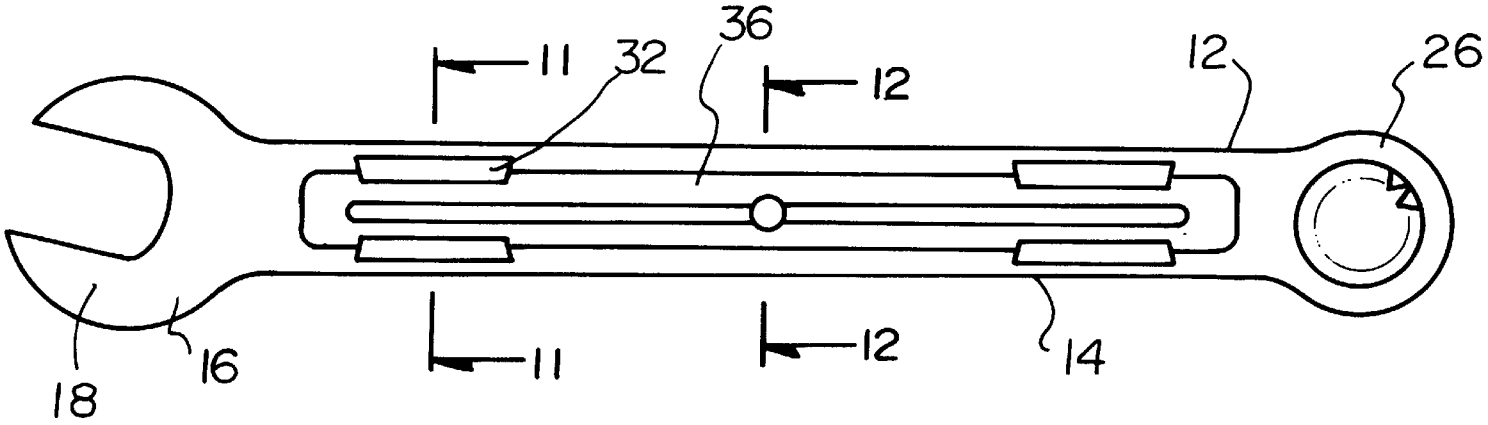
FIG. 10 is a side view of an alternate embodiment of the present invention.
Figure 12:
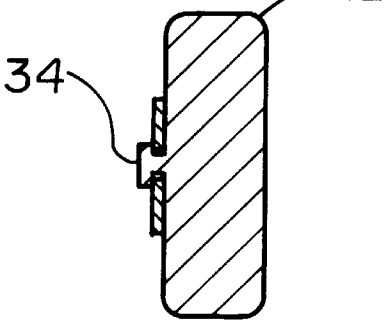
FIG. 12 is a cross-sectional view of the present invention taken along line 12—12 shown in FIG. 10.
Figure 11:
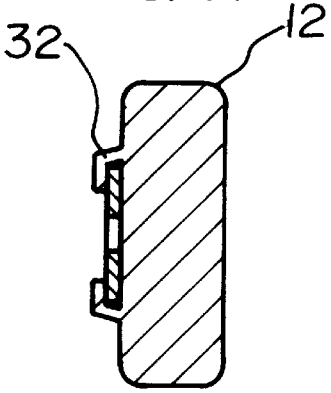
FIG. 11 is a cross-sectional view of the present invention taken along line 11—11 shown in FIG. 10.

In another embodiment, each wrench includes two pairs of guides 32 each with an L-shaped cross-section and being spacedly coupled to ends of the intermediate extent on a common face thereof. Associated therewith is a knob 34 with a T-shaped cross-section coupled to a central extent of the face of the intermediate extent. Also included is a slider bar 36 having a substantially planar rectangular configuration defined by a pair of elongated side edges and a pair of short edges. The slider bar preferably has a length about equal to that of the intermediate extent. As shown in FIGS. 10–12, the slider bar has a central slit formed therein between the end edges and in parallel with the side edges. The side edges of the slider bar are slidably received between the guides such that the knob extends through the slit. By this structure, the slider bar may be selectively positioned over one of the end extents of the wrench. The bars of the foregoing embodiments are critical for engaging a top face of the nut or bolt to maintain an inner periphery in engagement with the nut or bolt.

Figure 7:
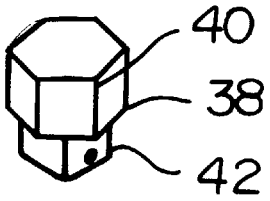
FIG. 7 is perspective view of the adapter of the present invention.

FIG. 7 shows an adapter 38 including a head 40 with a periphery having a substantially hexagonal configuration. A substantially cubical couple 42 is integrally formed on a central extent of a bottom face of the head of the adapter and extends therefrom. A side face of the cubical couple has a spring biased ball bearing mounted thereon. As such, the couple of the adapter is adapted for releasably coupling with socket wrench bits such that a single wrench of the present invention may be used with a set of socket wrench bits to manipulate bolts and nuts of varying sizes.

Figure 8:
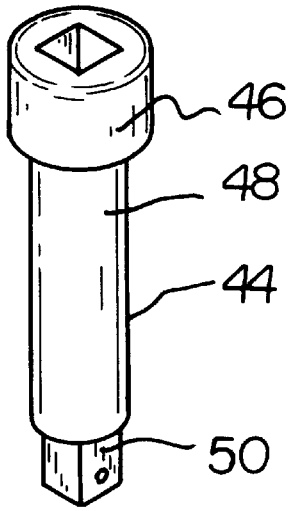
FIG. 8 is a perspective view of the extension of the present invention.

Associated therewith is an extension 44 including a substantially disk-shaped upper portion 46 with a cubical cut out formed in a top face thereof. The extension is thus adapted for releasably receiving the couple of the adapter. As shown in FIG. 8, the extension is further defined by an elongated substantially cylindrical intermediate portion 48. A substantially cubical lower portion 50 is equipped with a spring biased ball bearing mounted thereon such that the lower portion of the extension is adapted for releasably coupling with the socket wrench bits.

Figure 9:
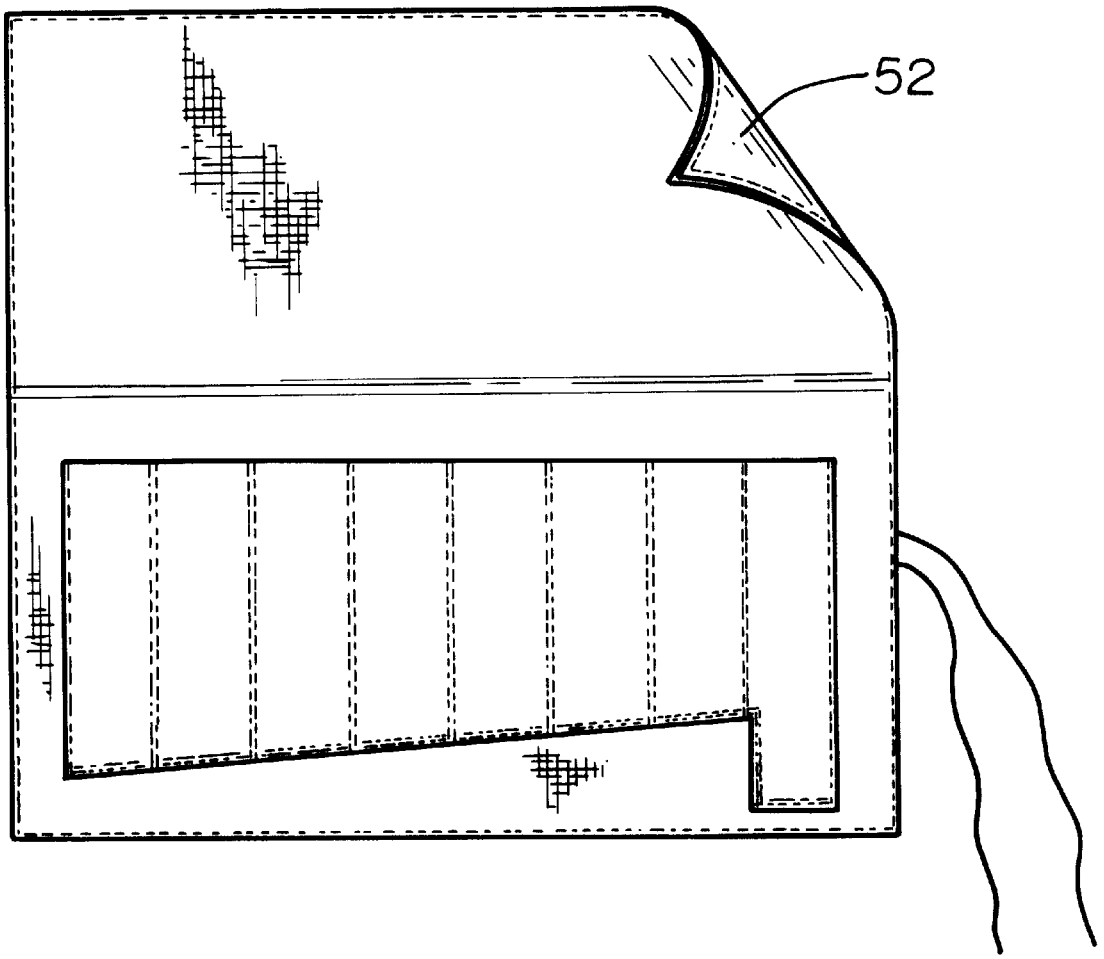
FIG. 9 is a side view of the pouch of the present invention.

As shown in FIG. 9, a pouch 52 is constructed from a flexible material. The pouch includes a pair of substantially rectangular halves hingably coupled. One of the halves has a plurality of parallel slots of varying lengths coupled thereto of receiving the wrenches therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A wrench for rotating a fastener having a predetermined size with opposite engagement faces, the wrench comprising:

a handle;

at least one end extent coupled to an end of the handle, the end extent having a pair of opposite faces and including a cut out defining an inner periphery formed of an inboard portion with a smooth substantially arcuate configuration with a predetermined diameter adapted to permit the fastener of the predetermined size to pass through the inboard portion an engagement middle portion defined by a pair of linear parallel edges spaced apart a predetermined distance adapted to engage the opposite engagement faces of the fastener, the predetermined distance less than the predetermined diameter, an outboard portion having ends extending toward each other such that the fastener of the predetermined size is blocked from passing between the ends; and a bar fixedly mounted on one of the faces of the end extent and extending adjacent the parallel edges of the middle portion for blocking movement of the fastener through a plane of the face of the end extent when the fastener is positioned between the parallel edges of the middle portion ot the end extent.

2. A wrench as set forth in claim 1 wherein the bar is elongate with a longitudinal axis oriented in perpendicular relationship with the edges of the middle portion of the end extent.

3. A wrench as set forth in claim 1 wherein the bar extends across centers of the edges of the middle portion of the end extent.

4. A wrench as set forth in claim 1 and further including an adapter including a head with a periphery having a substantially hexagonal configuration and a couple integrally formed on a central extent of a bottom face of the head of the adapter and extending therefrom, wherein a side face of the couple has a detent such that the couple of the adapter is adapted for releasably coupling with socket wrench bits.

5. A wrench for rotating a fastener having a predetermined size with opposite engagement faces, the wrench comprising:

a handle;

at least one end extent coupled to an end of the handle, the end extent having a pair of opposite faces and including a cut out defining an inner periphery formed of an inboard portion with a smooth substantially arcuate configuration with a predetermined diameter adapted to permit the fastener of the predetermined size to pass through the inboard portion, an engagement middle portion defined by a pair of linear parallel edges spaced apart a predetermined distance adapted to engage the opposite engagement faces of the fastener, the predetermined distance less than the predetermined diameter, an outboard portion having ends extending toward each other such that the fastener of the predetermined size is blocked from passing between the ends;

a bar fixedly mounted on one of the faces of the end extent and extending adjacent the parallel edges of the middle portion for blocking movement of the fastener through a plane of the face of the end extent when the fastener is positioned between the parallel edges of the middle portion of the end extent; and an adapter including a head with a periphery having a substantially hexagonal configuration and a couple integrally formed on a central extent of a bottom face of the head of the adapter and extending therefrom wherein a side face of the couple has a detent such that the couple of the adapter is adapted for releasably coupling with socket wrench bits;

wherein the bar is elongate with a longitudinal axis oriented in perpendicular relationship with the edges of the middle portion of the end extent;

wherein the bar extends across centers of the edges of the middle portion of the end extent.

* * * * *